US012311421B2

(12) United States Patent
Tsukamoto et al.

(10) Patent No.: US 12,311,421 B2
(45) Date of Patent: May 27, 2025

(54) COLD ROLLING METHOD AND METHOD FOR PRODUCING COLD-ROLLED STEEL SHEET

(71) Applicant: JFE STEEL CORPORATION, Tokyo (JP)

(72) Inventors: Kengo Tsukamoto, Tokyo (JP); Kenji Suzuki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 159 days.

(21) Appl. No.: 18/254,169

(22) PCT Filed: Oct. 15, 2021

(86) PCT No.: PCT/JP2021/038312
§ 371 (c)(1),
(2) Date: May 24, 2023

(87) PCT Pub. No.: WO2022/123911
PCT Pub. Date: Jun. 16, 2022

(65) Prior Publication Data

US 2024/0033798 A1 Feb. 1, 2024

(30) Foreign Application Priority Data

Dec. 7, 2020 (JP) ..... 2020-202875

(51) Int. Cl.
*B21B 37/24* (2006.01)

(52) U.S. Cl.
CPC ..... *B21B 37/24* (2013.01)

(58) Field of Classification Search
CPC ... B21B 2001/221; B21B 37/16; B21B 37/24; B21B 37/48; B21B 38/04; B21B 38/06
See application file for complete search history.

(56) References Cited

U.S. PATENT DOCUMENTS 7,797,974 B2 * 9/2010 Kruger ..... B21B 37/28 72/8.7
9,056,343 B2 * 6/2015 Su ..... B21B 45/02

FOREIGN PATENT DOCUMENTS

CN 103495606 A * 1/2014
CN 107052049 A * 8/2017
(Continued)

OTHER PUBLICATIONS

Nov. 16, 2021, International Search Report issued in the International Patent Application No. PCT/JP2021/038312.
(Continued)

*Primary Examiner* — Edward T Tolan
(74) *Attorney, Agent, or Firm* — KENJA IP LAW PC

(57) ABSTRACT

Provided is a cold rolling method by which the occurrence of wrinkles during cold rolling can be prevented without having to modify a mill. A cold rolling method of rolling a steel sheet in multiple rolling passes using a cold mill, the method including when the steel sheet unit tension $N_1$ during steady-state rolling exceeds the reference unit tension $N_0$ in a specific rolling pass in which the target sheet thickness $t_0$ on an exit side of the rolling pass is less than or equal to a reference sheet thickness, controlling the steel sheet unit tension $N_2$ in an initial stage of rolling on an entry side of the specific rolling pass to be less than the reference unit tension $N_0$ and less than the steel sheet unit tension $N_1$ during the steady-state rolling, the reference unit tension $N_0$ is calculated by the formula (1): $N_0=(150/9)t_0+27.1$.

16 Claims, 4 Drawing Sheets

(56) References Cited

FOREIGN PATENT DOCUMENTS

| | | | | |
|---|---|---|---|---|
| EP | 3715002 | A1 | | 9/2020 |
| JP | H04182019 | A | | 6/1992 |
| JP | H04294813 | A | | 10/1992 |
| JP | 09-253738 | A | * | 9/1997 |
| JP | 2019141874 | A | | 8/2019 |
| KR | 20130022868 | A | * | 3/2013 |

OTHER PUBLICATIONS

Apr. 22, 2024, the Extended European Search Report issued by the European Patent Office in the corresponding European Patent Application No. 21903015.2.

* cited by examiner

*Steel sheet unit tension during steady-state rolling 30kg/mm²
× : Rate of occurrence of wrinkles > 2 %
○ : Rate of occurrence ≦ 2 %

COLD ROLLING METHOD AND METHOD FOR PRODUCING COLD-ROLLED STEEL SHEET

TECHNICAL FIELD

The present disclosure relates to a cold rolling method and a method for producing a cold-rolled steel sheet.

BACKGROUND

In recent years, global environmental considerations have led to calls for weight reduction in transportation equipment, such as automobiles, and industrial equipment. Cold-rolled steel sheets are often used as structural materials for the transportation and industrial equipment, and demand for thinner cold-rolled steel sheets has increased significantly in order to reduce the weight of the transportation and industrial equipment.

As in the example of FIG. 1, which illustrates a cold-rolled steel sheet rolled into a coil after cold rolling, when producing thin cold-rolled steel sheets, wrinkles (longitudinal wrinkles) may occur near the axial centers of coils after cold rolling. As described in Patent Literature (PTL) 1, such wrinkles easily occur in thin cold-rolled steel sheets, and they are expected to occur more and more as the thinning of cold-rolled steel sheets will be promoted in the future.

PTL 1 also proposes the application of a wrinkle-preventing roll to a mill as a means of preventing the occurrence of such wrinkles.

CITATION LIST

Patent Literature

PTL 1: JP 2019-141874 A

SUMMARY

Technical Problem

The method proposed in PTL 1 is to newly install the wrinkle-preventing roll in the mill, and this requires modification of the mill and increases equipment cost. Methods that are superior in terms of economic efficiency have therefore been sought.

It would be helpful to provide a cold rolling method by which the occurrence of wrinkles during cold rolling can be prevented without having to modify a mill, and a method for producing a cold-rolled steel sheet using the cold rolling method.

Solution to Problem

Primary features of the present disclosure will be described below.

1. A cold rolling method of rolling a steel sheet in multiple rolling passes using a cold mill, the cold rolling method including when the steel sheet unit tension $N_1$ during steady-state rolling exceeds the reference unit tension $N_0$ calculated by the following formula (1) in a specific rolling pass in which the target sheet thickness $t_0$ on an exit side of the rolling pass is less than or equal to a reference sheet thickness, controlling the steel sheet unit tension $N_2$ in an initial stage of rolling on an entry side of the specific rolling pass to be less than the reference unit tension $N_0$ and less than the steel sheet unit tension $N_1$ during the steady-state rolling $$N_0=(150/9)t_0+27.1 \quad (1).$$

Here, the term "target sheet thickness $t_0$" is a set value of sheet thickness on an exit side of a rolling pass that is determined for each rolling pass in accordance with a rolling schedule with multiple rolling passes. The term "reference sheet thickness" is a threshold sheet thickness at which wrinkles may occur in a steel sheet after rolling, as indicated by 0.15 mm in the example of FIG. 5, for example. The term "reference unit tension $N_0$" is a calculated value of unit tension that is likely to cause wrinkles at a front end of a steel sheet on an exit side of a specific rolling pass during rolling in the specific rolling pass in which $t_0 \leq$reference sheet thickness, as will be explained in detail later using FIG. 5. The terms "front end" and "unit tension" are defined as will be described later. The term "steady-state rolling" corresponds to a stage of rolling in a rolling pass in which the sheet passing speed has become constant after the start of rolling and, and the "steel sheet unit tension during steady-state rolling" is a set value that is determined in advance before the steel sheet is passed through the rolling pass. The term "initial stage of rolling" is a stage of rolling immediately after the start of rolling when a steel sheet is passed through the rolling pass, and the "steel sheet unit tension in the initial stage of rolling" can be measured on an entry side of the rolling pass.

2. A cold rolling method of rolling a steel sheet in multiple rolling passes using a cold mill, the cold rolling method including when the steel sheet unit tension $N_1$ during steady-state rolling exceeds the reference unit tension $N_0$ calculated by the following formula (1) in a specific rolling pass in which the target sheet thickness $t_0$ on an exit side of the rolling pass is less than or equal to a reference sheet thickness, controlling the front end sheet thickness $t_1$ on the exit side of the specific rolling pass to be greater than the target sheet thickness $t_0$.

$$N_0=(150/9)t_0+27.1 \quad (1).$$

Here, the term "front end" refers to an area from a leading end of a steel sheet that is passed through a specific rolling pass to 0.5% of the total length of the steel sheet in the longitudinal direction, and under normal operating conditions, it corresponds to a length of 50 m to 100 m from the leading end.

3. The cold rolling method according to 1 above, further including controlling the front end sheet thickness $t_1$ on the exit side of the specific rolling pass to be greater than the target sheet thickness $t_0$.
4. The cold rolling method according to 2 above, further including controlling the steel sheet unit tension $N_2$ in an initial stage of rolling on an entry side of the specific rolling pass to be less than the reference unit tension $N_0$ and less than the steel sheet unit tension $N_1$ during the steady-state rolling.
5. The cold rolling method according to any one of 1 to 4 above, wherein the steel sheet contains 2.0 mass % to 4.0 mass % of Si, and the reference sheet thickness is 0.15 mm.

6. A method for producing a cold-rolled steel sheet by using the cold rolling method according to any one of 1 to 5 above.

Advantageous Effect

According to the present disclosure, because the occurrence of wrinkles is prevented in particular during cold rolling for producing a thin cold-rolled steel sheet, the production yield rate of cold-rolled steel sheets can be significantly improved.

The present disclosure can provide the above advantageous effect, even when a thin cold-rolled steel sheet with a thickness of 0.15 mm or less, even mm or less, even 0.12 mm or less, even 0.10 mm or less, or even less than 0.10 mm, is to be produced.

DETAILED DESCRIPTION

The cold rolling method according to the present disclosure will be described in detail below.

The cold rolling method according to the present disclosure is applicable to cold mills that produce cold-rolled steel sheets through multiple rolling passes, particularly suitable for cold mills that produce cold-rolled steel sheets through multiple passes of reverse rolling. Specifically, it can be suitably applied to Sendzimir mills, reverse mills, or the like. It can, however, also be applied, for example, to tandem mills, without being limited to the above mills. In addition, the cold rolling method according to the present disclosure can be applied to implement the method for producing a cold-rolled steel sheet according to the present disclosure, and the producing method according to the present disclosure provides the same effects as the cold rolling method according to the present disclosure. In the following, the present disclosure will be described with reference to the figures, using a Sendzimir mill as a typical example of cold mills.

Figure 2:
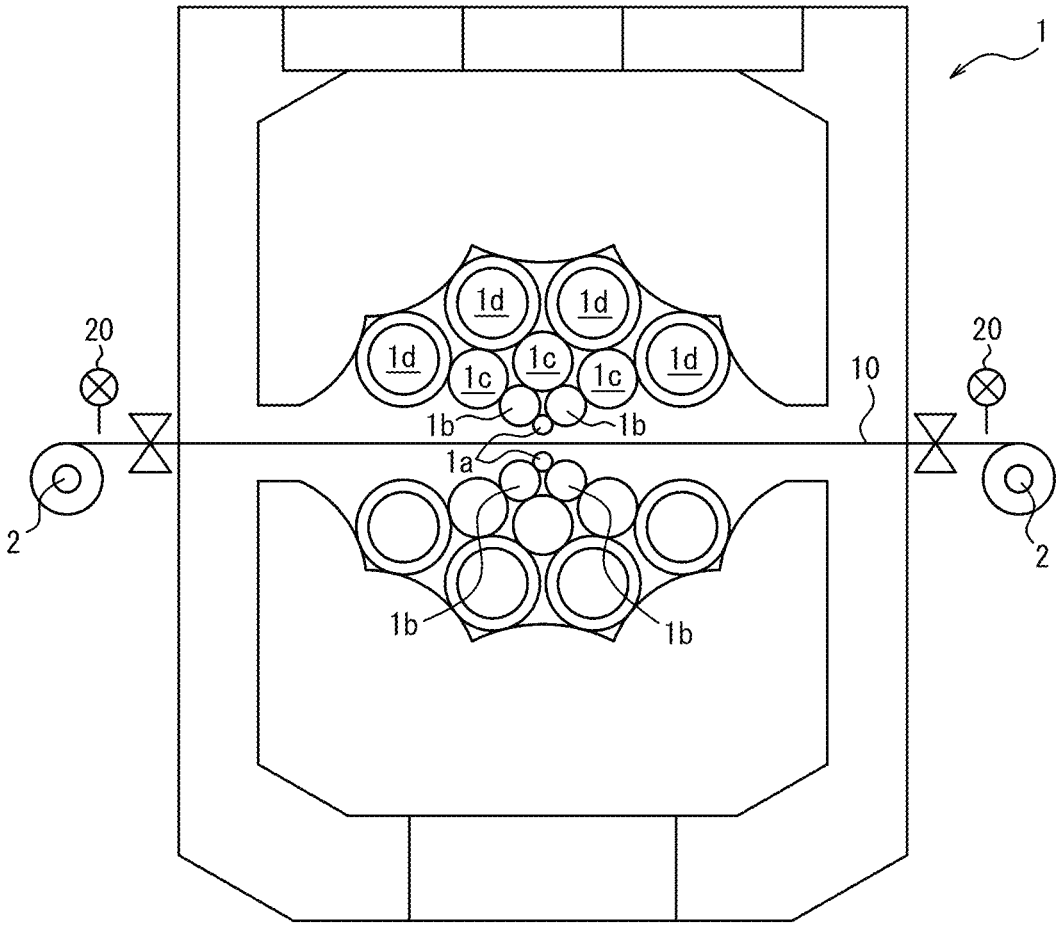
FIG. 2 is a cross-sectional schematic diagram illustrating a configuration of a Sendzimir mill.

As illustrated in FIG. 2, a Sendzimir mill 1 includes, for example, a pair of work rolls 1*a* that sandwiches and rolls a steel sheet 10 (material to be rolled) from above and below, first intermediate rolls 1*b*, second intermediate rolls 1*c*, and backup bearings 1*d* (backing assembly).

The Sendzimir mill 1 is configured to allow for reciprocating rolling (reverse rolling) of the steel sheet 10, by switching the transfer direction (i.e., the direction of the pass line from the entry side to the exit side of the rolling pass) of the steel sheet 10 between one direction (e.g., from left to right on the figure) and the opposite direction (e.g., from right to left on the figure). For this purpose, reels 2 are disposed on upstream and downstream sides of the Sendzimir mill 1. Each reel 2 serves to both wind and unwind the steel sheet depending on the rolling direction. Typically, radiation thermometers 20 that can measure the temperature of a steel sheet are also disposed in the Sendzimir mill 1.

The Sendzimir mill 1 is also equipped with a control unit 3, which controls various rolling conditions so as to perform reverse rolling with a predetermined number of passes on the steel sheet 10, the material to be rolled, to thereby produce a cold-rolled steel sheet of desired specifications. That is, the pass schedule is set in accordance with, mainly, the sheet thickness of the target cold-rolled steel sheet, and the rolling conditions are further set for each pass.

Figure 3:
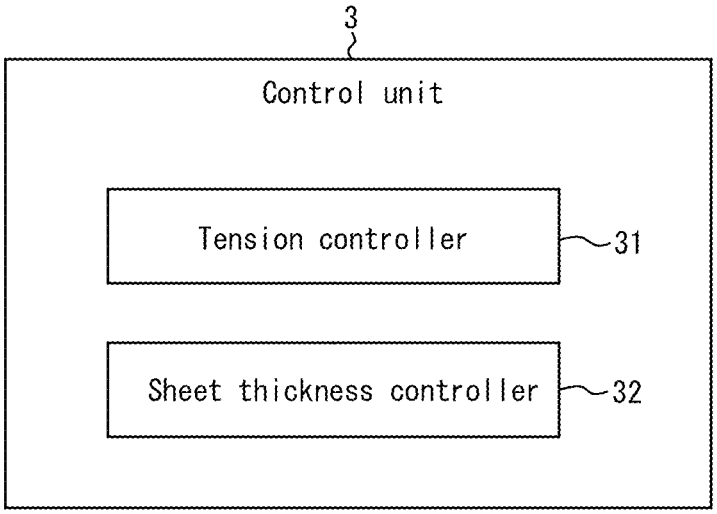
FIG. 3 is a block diagram illustrating a control unit equipped in the Sendzimir mill.

As illustrated in a block diagram of FIG. 3, the control unit 3 is configured to include a tension controller 31 and a sheet thickness controller 32. First, the tension controller 31 controls the rotation of the upstream and downstream reels 2 so that the unit tension set for each rolling pass is applied to the steel sheet. Then, the sheet thickness controller 32 controls the rolling load of the Sendzimir mill 1 so that the sheet thickness of the steel sheet 10 after rolling in a certain rolling pass coincides with a set value of the target sheet thickness on the exit side of the rolling pass.

The present inventors have conducted earnest studies on means of preventing wrinkles that are likely to occur on steel sheets when cold rolling is performed using such a cold mill, especially for producing thin cold-rolled steel sheets. In order to prevent wrinkles, we have first focused on unit tension and sheet thickness, which are control categories in the control unit 3, and in particular on changing set values of unit tension and sheet thickness from normal conditions in a specific rolling pass in which wrinkles tend to occur.

The reasons why the present inventors have focused on the set values of unit tension and sheet thickness in a specific rolling pass will be described below. The term "unit tension" means tension ($kg/mm^2$) per unit cross-sectional area applied to a steel sheet (material to be rolled).

Figure 4:
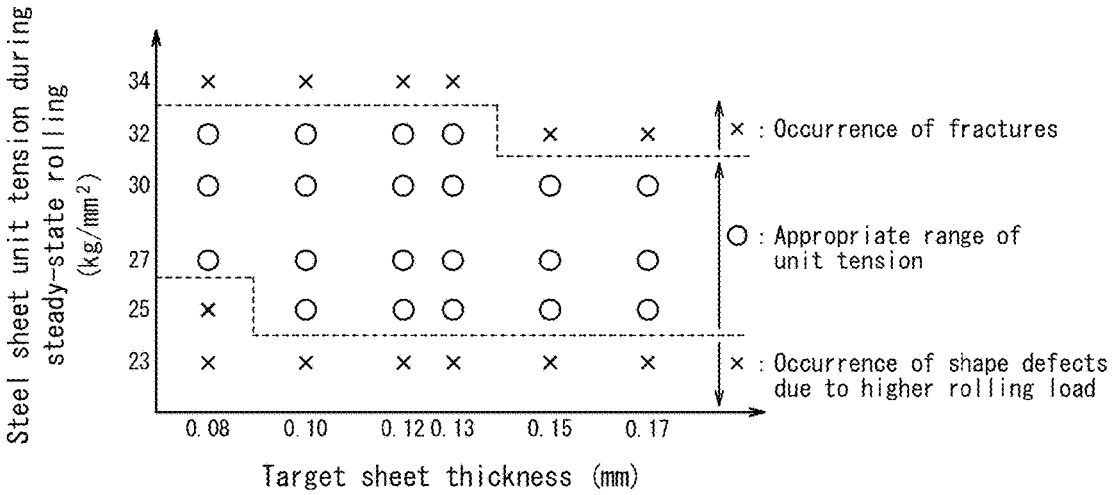
FIG. 4 illustrates an appropriate range of steel sheet unit tension during steady-state rolling with respect to target sheet thickness.

As illustrated in FIG. 4, when a material to be rolled is cold-rolled, appropriate unit tension (steel sheet unit tension during steady-state rolling) on an exit side of the rolling pass generally depends on the target sheet thickness, but it is generally 25 $kg/mm^2$ to 32 $kg/mm^2$ (range indicated by "o" in FIG. 4), provided that the sheet thickness is approximately 0.2 mm or less. Rolling at higher unit tension than the appropriate range tends to cause fractures of the steel sheet, while rolling at lower unit tension than the appropriate range tends to cause shape defects of the steel sheet due to higher rolling load (both indicated by "x" in FIG. 4).

Figure 1:
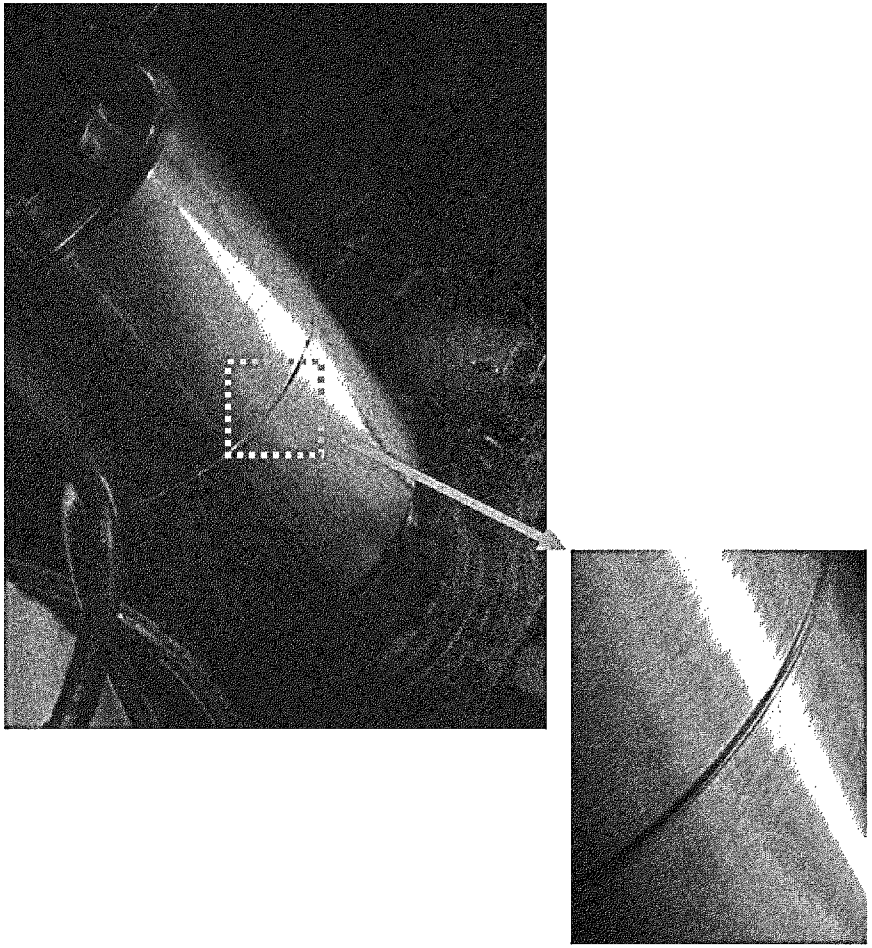
FIG. 1 illustrates photographs of a take-up coil of a cold-rolled steel sheet in which wrinkles have occurred.

However, even when rolling is performed at unit tension within the appropriate range, wrinkles sometimes occur in the coil, as illustrated in FIG. 1.

The present inventors have conducted a closer study of the coil of FIG. 1 in which wrinkles have occurred after coiling and found that the wrinkles did not occur over the entire length of the steel sheet before coiling, but occurred mainly at the front end of the steel sheet, specifically in the area extending 50 m to 100 m from the leading end in the rolling direction of the steel sheet. That is, it has been newly found that wrinkles do not occur anywhere except the front end before the coiling of the steel sheet, but when the steel sheet is coiled, a wrinkle-free part of the steel sheet is successively wound around the coiling-start portion (front end) with wrinkles, and the wrinkles at the front end are transferred from the front end to the rear side, resulting in the entire coil being wrinkled.

Figure 5:
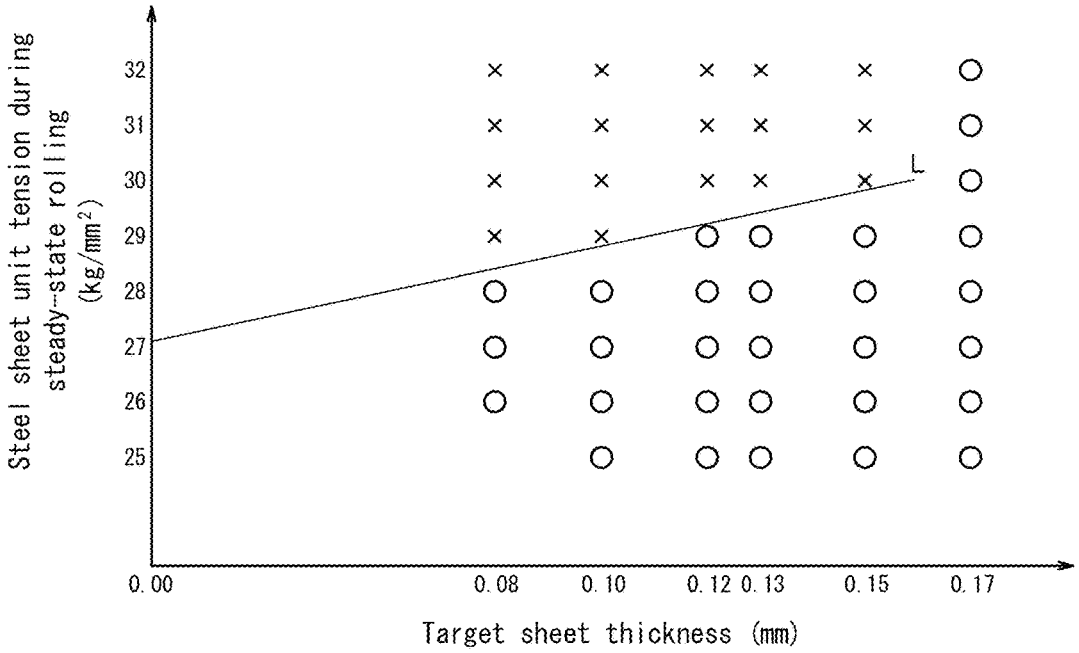
FIG. 5 illustrates the relationship between steel sheet unit tension during steady-state rolling and target sheet thickness with respect to the occurrence of wrinkles in steel sheets.

The present inventors therefore investigated the unit tension at which wrinkles tend to occur at front ends of steel sheets within the appropriate range of unit tension. The results are presented in FIG. 5. As illustrated in FIG. 5, it has also been found that wrinkles tend to occur when rolling is performed at relatively high unit tension (steel sheet unit tension during steady-state rolling) even if the unit tension is within the appropriate range, and that wrinkles occur in a rolling pass (specific rolling pass) among multiple rolling passes in which the sheet thickness mainly after rolling, expressed as the target sheet thickness, is less than or equal to a certain threshold (in cold rolling examples of FIG. 5, 0.15 mm, which is referred to as a reference sheet thickness). Furthermore, the unit tension at which wrinkles occur decreases as the target sheet thickness decreases, and this has led us to speculate that there may be a correlation between the unit tension at which wrinkles occur and sheet thickness. FIG. 5 illustrates the boundary between "x", which indicates that wrinkles have occurred, and "o", which indicates that the occurrence of wrinkles has been prevented, by the line segment L that approximates a linear relationship. The line segment L has led us to consider that wrinkles tend to occur at a front end when steel sheet unit tension during steady-state rolling exceeds the reference unit tension $N_0$ calculated by the formula (1) below. That is, the reference unit tension $N_0$ means a reference value of unit tension at which wrinkles are highly likely to occur at a front end of a steel sheet due to rolling in a specific rolling pass, and it can be expressed as follows in terms of absolute value in relation to $t_0$.

$$N_0=(150/9)t_0+27.1 \quad (1),$$

where $t_0$ is the target sheet thickness on the exit side of rolling pass after rolling in the specific rolling pass.

The reasons for the above may be as follows. Wrinkles tend to occur in part of a steel sheet that is in an elongated shape, and tension distribution occurs in a steel sheet with an uneven shape in the width direction. When steel sheet unit tension during steady-state rolling exceeds the aforementioned reference unit tension $N_0$, deviation of tension distribution during cold rolling becomes larger in accordance with unevenness in shape, and the buckling stress value becomes larger in the width direction, and this is presumed to be the cause of wrinkles.

Additionally, the sheet thickness (reference sheet thickness) that serves as the threshold for whether wrinkles occur is a value that varies depending on the pass schedule and steel sheet material properties, and it is experimentally derived and determined as appropriate for each cold rolling operation. For example, the reference sheet thickness is 0.15 mm for steel sheets containing 2.0 mass % to 4.0 mass % of Si, especially electrical steel sheets with an Si content of 2.0 mass % to 4.0 mass %. The lower limit of the target sheet thickness in the cold rolling process is not limited and may be greater than 0 mm, for example, 0.05 mm or more.

Next, as methods of preventing wrinkles, the present inventors have examined the following two methods, i.e., "tension control" and "sheet thickness control."

Tension Control

The first one is a method of adjusting tension during rolling of a front end of a steel sheet, when the steel sheet unit tension $N_1$ during steady-state rolling exceeds the aforementioned reference unit tension $N_0$ in a specific rolling pass among multiple rolling passes in which the target sheet thickness after rolling is less than or equal to the aforementioned reference sheet thickness. Based on the aforementioned mechanism of occurrence of wrinkles, the present inventors have hypothesized that the occurrence of wrinkles may be prevented, by adjusting unit tension on an entry side during rolling of a front end of a steel sheet in a specific rolling pass (at the start of rolling), i.e., the steel sheet unit tension $N_2$ in an initial stage of rolling on the entry side of the specific rolling pass, to be less than both the reference unit tension $N_0$ and the unit tension $N_1$ during steady-state rolling, without changing the steel sheet unit tension $N_1$ during the steady-state rolling (constant-rate rolling). In order to verify the above hypothesis, the present inventors have conducted experiments to determine whether wrinkles occur when cold rolling electrical steel sheets containing 3.4 mass % of Si, while changing the steel sheet unit tension $N_2$ in an initial stage of rolling on an entry side of each specific rolling pass in various ways within the unit tension $N_1$ during steady-state rolling, with the steel sheet unit tension $N_1$ during steady-state rolling being fixed at 30 kg/mm$^2$.

Figure 6:
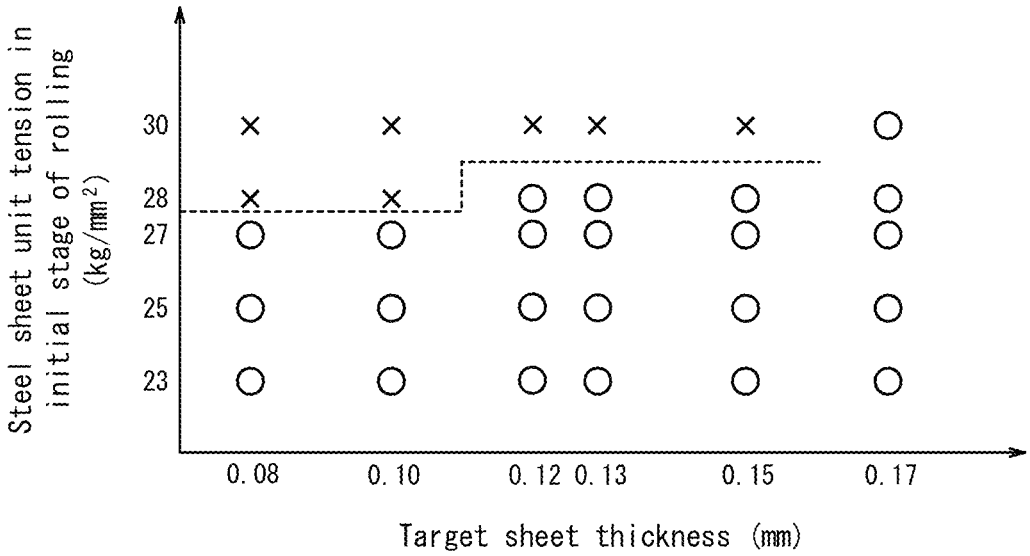
FIG. 6 illustrates the relationship between steel sheet unit tension in an initial stage of rolling and target sheet thickness with respect to the occurrence of wrinkles in steel sheets.

As the results are illustrated in FIG. 6, it has been found that wrinkles occur when the target sheet thickness is 0.15 mm or less, but the occurrence of wrinkles is prevented by adjusting the steel sheet unit tension $N_2$ in an initial stage of rolling to be less than the reference unit tension $N_0$ calculated based on the corresponding target sheet thickness $t_0$ and less than the steel sheet unit tension $N_1$ during steady-state rolling ($N_1$=30 kg/mm$^2$ in the examples of FIG. 6). Additionally, this time 10 coils per day were cold-rolled for 50 days, and when the rate of occurrence of wrinkles was greater than 2%, it was marked with "x" as the occurrence of wrinkles was not prevented, and when the rate of occurrence of wrinkles was less than or equal to 2%, it was marked with "o" as the occurrence of wrinkles was prevented.

In a case in which the steel sheet unit tension $N_2$ in an initial stage of rolling is controlled by the ratio of the steel sheet unit tension $N_2$ in the initial stage of rolling to the steel sheet unit tension $N_1$ during steady-state rolling (hereinafter referred to as "tension ratio $N_2/N_1$"), as demonstrated in FIG. 6, the occurrence of wrinkles can be prevented, by adjusting the steel sheet tension $N_2$ in the initial stage of rolling to be less than, preferably 95% or less of, and more preferably 90% or less of, the steel sheet unit tension $N_1$ during steady-state rolling. Additionally, as illustrated in FIG. 4, because the steel sheet unit tension $N_1$ during steady-state rolling is generally considered to increase as the sheet thickness decreases, the ratio of the steel sheet unit tension $N_2$ in the initial stage of rolling to the steel sheet unit tension $N_1$ during steady-state rolling is preferably lowered as the sheet thickness decreases. Although not illustrated in FIG. 6, for example, when it is assumed that the target sheet thickness is 0.10 mm and the steel sheet unit tension $N_1$ during steady-state rolling in a specific rolling pass is 32 kg/mm$^2$, and the steel sheet unit tension $N_2$ in the initial stage of rolling is adjusted to be 28 kg/mm$^2$ or less, the ratio is 87.5% or less. This tension ratio $N_2/N_1$ is more preferably 85% or less.

Here, the lower limit of the steel sheet unit tension $N_2$ in the initial stage of rolling is not particularly specified. However, excessively low steel sheet unit tension $N_2$ will cause slips due to a decrease in forward slip ratio during rolling and deformation due to an increase in rolling load. The steel sheet unit tension $N_2$ can therefore be reduced to the extent where it does not cause such problems. The steel sheet unit tension $N_2$ in the initial stage of rolling can be, for example, 70% or more of the unit tension $N_1$ during steady-state rolling.

Additionally, the steel sheet unit tension $N_1$ during steady-state rolling is determined for each rolling pass according to a system that generates information for each coil.

Sheet Thickness Control

The second one is a method of controlling the front end sheet thickness $t_1$ on an exit side of a specific rolling pass to be greater than the target sheet thickness $t_0$ on the exit side of the specific rolling pass, when the steel sheet unit tension $N_1$ during steady-state rolling exceeds the aforementioned reference unit tension $N_0$ in the specific rolling pass among multiple rolling passes in which the target sheet thickness after rolling is less than or equal to the aforementioned reference sheet thickness. From FIG. 6 described above, it can be seen that if the target sheet thickness $t_0$ is large, wrinkles are less likely to occur even when the steel sheet unit tension $N_2$ in an initial stage of rolling is high. This has led us to discover that the occurrence of wrinkles can also be prevented, by adjusting the front end sheet thickness $t_1$ on an exit side of a specific rolling pass to be greater than the aforementioned target sheet thickness $t_0$. The reason is thought to be that with its large sheet thickness, the front end of the steel sheet, at which wrinkles particularly tend to occur due to a large deviation in tension distribution, can withstand buckling stresses. In a case in which the front end sheet thickness $t_1$ is adjusted to be greater than the target sheet thickness $t_0$, when the sheet thickness $t_2$ on the entry side of the specific rolling pass is greater than the reference sheet thickness, the occurrence of wrinkles can be prevented, by controlling the front end sheet thickness $t_1$ to be greater than the target sheet thickness $t_0$. On the other hand, even when the sheet thickness $t_2$ on the entry side of the specific rolling pass is less than or equal to the reference sheet thickness, the occurrence of wrinkles can be prevented, by adjusting the front end sheet thickness $t_1$ to be greater than the target sheet thickness $t_0$ and also by controlling it to a sheet thickness that is less likely to cause wrinkles against high unit tension. For example, with reference to FIG. 6, in a case in which the target sheet thickness is 0.10 mm, the occurrence of wrinkles can be prevented, by increasing the front end sheet thickness $t_0$ be 0.12 mm or more, even when the steel sheet unit tension (front end unit tension) in the initial stage of rolling is 28 kg/mm$^2$.

As described above, the occurrence of wrinkles can be prevented by either of the two cold rolling methods, and a decision on which method is to be used can be made as appropriate. That is, a wrinkle-free cold-rolled steel sheet can be produced by performing cold rolling according to one or both of the two cold rolling methods.

Additionally, immediately after undergoing a pass in which sheet thickness control, i.e., the second method, is performed, the steel sheet cannot be rolled in the next pass onward, because the front end has not reached the target sheet thickness. For this reason, the aforementioned sheet thickness control needs be performed in the final pass. Furthermore, the front end is cut for shipment, resulting in some waste. It is therefore preferable to prevent the occurrence of wrinkles by tension control, i.e., the first method. The sheet thickness control method is preferably implemented in place of or in combination with the tension control method, for example, in a case in which steel sheet unit tension (front end unit tension) in the initial stage of rolling in the final pass cannot be reduced to unit tension that can prevent the occurrence of wrinkles.

Tension values and sheet thickness values to be set in rolling passes will be described in detail below.

Tension Values

In conventional technology, tension is set uniformly for each rolling pass as the steel sheet unit tension $N_1$ during steady-state rolling. However, the present disclosure is characterized in particular in that, when the steel sheet unit tension $N_1$ during steady-state rolling exceeds the aforementioned reference unit tension $N_0$ in a specific rolling pass in which the target sheet thickness $t_0$ on an exit side of the rolling pass is less than or equal to the reference sheet thickness (threshold), tension setting for the specific rolling pass is different from other rolling passes. That is, in the specific rolling pass in the present disclosure, the steel sheet unit tension $N_2$, which is set for the initial stage of rolling from the start of rolling until the sheet passing speed (rolling speed) becomes constant (until constant-speed rolling or steady-state rolling is achieved), and the steel sheet unit tension $N_1$, which is set for the period of steady-state rolling from when the reference unit tension $N_0$ calculated from the target sheet thickness and the sheet passing speed (rolling speed) become constant until the end of rolling, are determined so that the following formulae are satisfied $$N_2<N_1 \text{ and } N_2<N_0.$$

In other words, the tension ratio $N_2/N_1<100\%$ and $N_2/N_0<100\%$.

On the other hand, in rolling passes other than the specific rolling pass, rolling is performed without any change from the set $N_1$, so $N_2=N_1$, in other words, the tension ratio $N_2/N_1=100\%$ holds.

Typically, the tension set value $N_1$ is determined automatically or by an operator as appropriate, depending on the type of the steel sheet (refer to FIG. 2) to be introduced into the mill. In the present disclosure, the tension set value $N_2$ relative to the tension set value $N_1$ (tension ratio $N_2/N_1$) may therefore be determined as appropriate, but from the viewpoint of both wrinkle occurrence prevention and rollability, it is preferably set as follows: $0.7\leq N_2/N_1\leq 0.95$, i.e., $70\%\leq N_2/N_1\leq 95\%$. $N_2/N_1$ is preferably 70% or more. $N_2/N_1$ is preferably 95% or less, and in a case in which the target sheet thickness is 0.10 mm or less, it is more preferably 90% or less.

Sheet Thickness Values

In conventional technology, sheet thickness is set uniformly for each rolling pass as the target sheet thickness $t_0$. However, the present disclosure is characterized in particular in that, when the steel sheet unit tension $N_1$ during steady-state rolling exceeds the aforementioned reference unit tension $N_0$ in a specific rolling pass, sheet thickness setting for the specific rolling pass is different from other rolling passes. That is, in the specific rolling pass in the present disclosure, the front end sheet thickness $t_1$ of the steel sheet on the exit side of the pass and the sheet thickness (target sheet thickness) to of part of the steel sheet other than the front end that is continuous with the front end in the longitudinal direction (rolling direction) are determined so that the following formulae are satisfied $t_1>t_0$, in other words, the sheet thickness ratio $t_1/t_0>100\%$.

On the other hand, in rolling passes other than the specific rolling pass, rolling is performed without any change from the set $t_0$, so $t_1=t_0$, in other words, the sheet thickness ratio $t_1/t_0=100\%$ holds.

Typically, the target sheet thickness $t_0$ is a target sheet thickness on the exit side of the specific rolling pass that is required to produce a product, and it is determined automatically or by an operator as appropriate according to the product. In the present disclosure, the front end sheet thickness $t_1$ on the exit side relative to the target sheet thickness $t_0$ (sheet thickness ratio $t_1/t_0$) may therefore be determined as appropriate, but from the viewpoint of both wrinkle occurrence prevention and yield rate, $t_1$ is preferably set to be 105% to 120% of $t_0$, i.e., $105\% \leq t_1/t_0 \leq 120\%$. $t_1/t_0$ is preferably 105% or more. $t_1/t_0$ is preferably 120% or less.

EXAMPLES

During cold rolling using the Sendzimir mill of FIG. 2 wherein the reference sheet thickness (threshold value) was 0.15 mm, when the steel sheet unit tension $N_1$ during steady-state rolling exceeded the aforementioned reference unit tension $N_0$ in a specific rolling pass in which the target sheet thickness $t_0$ was less than or equal to the reference sheet thickness, the steel sheet unit tension $N_2$ in an initial stage of rolling on an entry side of the specific rolling pass and/or the front end thickness $t_1$ (corresponding to the part from the leading end to 0.5% of the total length) of the steel sheet on an exit side of the specific rolling pass were/was changed in the various ways as illustrated in Tables 1 to 3. The state of occurrence of wrinkles on the surfaces of steel sheets was evaluated after 50 days of the above cold rolling operations (10 coils per day). Results of the evaluation are listed in Tables 1 to 3.

The state of occurrence of wrinkles was visually evaluated. When a result of evaluation is 2% or less, the product quality is considered good because it is no more than the target yield rate.

As illustrated in Tables 1 to 3, the occurrence of wrinkles can be prevented, either by controlling only one of the tension $N_2$ and the sheet thickness $t_1$ or by controlling a combination of both.

TABLE 1

| No. | Target sheet thickness $t_0$ (mm) | Steel sheet unit tension in initial stage of rolling $N_2$ (kg/mm$^2$) | Steel sheet unit tension during steady-state rolling $N_1$ (kg/mm$^2$) | Reference unit tension $N_0$ (kg/mm$^2$) | Tension ratio (*1) $N_2/N_1$ | Tension ratio (*2) $N_2/N_0$ | Rate of occurrence of wrinkles | Remarks |
|---|---|---|---|---|---|---|---|---|
| A1 | 0.15 | 30 | 30 | 29.60 | 100% | 101% | 5% | Comparative Example |
| A2 | 0.15 | 28 | 30 | 29.60 | 93% | 95% | 2% | Example |
| A3 | 0.15 | 27 | 30 | 29.60 | 90% | 91% | 1% | Example |
| A4 | 0.15 | 25 | 30 | 29.60 | 83% | 84% | 0% | Example |
| A5 | 0.13 | 30 | 30 | 29.27 | 100% | 102% | 5% | Comparative Example |
| A6 | 0.13 | 28 | 30 | 29.27 | 93% | 96% | 1% | Example |
| A7 | 0.13 | 25 | 30 | 29.27 | 83% | 85% | 0% | Example |
| A8 | 0.12 | 30 | 30 | 29.10 | 100% | 103% | 6% | Comparative Example |
| A9 | 0.12 | 27 | 30 | 29.10 | 90% | 93% | 1% | Example |
| A10 | 0.12 | 25 | 30 | 29.10 | 83% | 86% | 0% | Example |
| A11 | 0.10 | 27 | 30 | 28.77 | 90% | 94% | 2% | Example |
| A12 | 0.10 | 23 | 30 | 28.77 | 77% | 80% | 1% | Example |
| A13 | 0.08 | 30 | 32 | 28.43 | 94% | 106% | 4% | Comparative Example |
| A14 | 0.08 | 27 | 30 | 28.43 | 90% | 95% | 2% | Example |
| A15 | 0.08 | 25 | 30 | 28.43 | 83% | 88% | 1% | Example |

(*1) The ratio (percentage) of the steel sheet tension $N_2$ in the initial stage of rolling to the steel sheet unit tension $N_1$ during steady-state rolling, and $N_2/N_1$ = 100% means that the tension $N_2$ was not change-controlled.
(*2) The ratio (percentage) of the steel sheet tension $N_2$ in the initial stage of rolling to the reference unit tension $N_0$.

TABLE 2

| No. | Sheet thickness on entry side $t_2$ (mm) | Target sheet thickness $t_0$ (mm) | Front end sheet thickness on exit side $t_1$ (mm) | Steel sheet unit tension during steady-state rolling $N_1$ (kg/mm$^2$) | Reference unit tension $N_0$ (kg/mm$^2$) | Sheet thickness ratio (*3) $t_1/t_0$ | Rate of occurrence of wrinkles | Remarks |
|---|---|---|---|---|---|---|---|---|
| B1 | 0.19 | 0.15 | 0.150 | 30 | 29.60 | 100% | 5% | Comparative Example |
| B2 | 0.19 | 0.15 | 0.160 | 30 | 29.60 | 107% | 1% | Example |
| B3 | 0.17 | 0.13 | 0.130 | 30 | 29.27 | 100% | 5% | Comparative Example |
| B4 | 0.17 | 0.13 | 0.154 | 30 | 29.27 | 118% | 0% | Example |
| B5 | 0.15 | 0.12 | 0.120 | 30 | 29.10 | 100% | 6% | Comparative Example |
| B6 | 0.15 | 0.12 | 0.130 | 30 | 29.10 | 108% | 1% | Example |
| B7 | 0.12 | 0.10 | 0.100 | 30 | 28.77 | 100% | 3% | Comparative Example |
| B8 | 0.12 | 0.10 | 0.120 | 30 | 28.77 | 120% | 0% | Example |
| B9 | 0.10 | 0.08 | 0.080 | 32 | 28.43 | 100% | 4% | Comparative Example |
| B10 | 0.10 | 0.08 | 0.085 | 32 | 28.43 | 106% | 1% | Example |

(*3) The ratio (percentage) of the front end sheet thickness $t_1$ to the target sheet thickness $t_0$, and $t_1/t_0$ = 100% means that the sheet thickness $t_1$ was not change-controlled.

TABLE 3

| No. | Sheet thickness on entry side $t_2$ (mm) | Target sheet thickness on exit side $t_0$ (mm) | Front end sheet thickness on exit side $t_1$ (mm) | Steel sheet unit tension in initial stage of rolling $N_2$ (kg/mm$^2$) | Steel sheet unit tension during steady-state rolling $N_1$ (kg/mm$^2$) | Reference unit tension $N_0$ (kg/mm$^2$) | Sheet thickness ratio (*3) $t_1/t_0$ | Tension ratio (*1) $N_2/N_1$ | Tension ratio (*2) $N_2/N_0$ | Rate of occurrence of wrinkles | Remarks |
|---|---|---|---|---|---|---|---|---|---|---|---|
| C1 | 0.19 | 0.15 | 0.150 | 30 | 30 | 29.60 | 100% (No control) | 100% (No control) | 101% | 5% | Comparative Example |
| C2 | 0.19 | 0.15 | 0.165 | 28 | 30 | 29.60 | 110% | 93% | 95% | 0% | Example |
| C3 | 0.17 | 0.13 | 0.130 | 30 | 30 | 29.27 | 100% (No control) | 100% (No control) | 102% | 5% | Comparative Example |
| C4 | 0.17 | 0.13 | 0.145 | 29 | 30 | 29.27 | 112% | 97% | 99% | 1% | Example |
| C5 | 0.15 | 0.12 | 0.120 | 30 | 30 | 29.10 | 100% (No control) | 100% (No control) | 103% | 6% | Comparative Example |
| C6 | 0.15 | 0.12 | 0.125 | 27 | 30 | 29.10 | 104% | 90% | 93% | 0% | Example |
| C7 | 0.12 | 0.10 | 0.100 | 30 | 30 | 29.10 | 100% (No control) | 100% (No control) | 103% | 4% | Comparative Example |
| C8 | 0.12 | 0.10 | 0.120 | 28 | 30 | 28.77 | 120% | 93% | 97% | 0% | Example |
| C9 | 0.10 | 0.08 | 0.080 | 30 | 32 | 28.43 | 100% (No control) | 94% | 106% | 4% | Comparative Example |
| C10 | 0.10 | 0.08 | 0.090 | 27 | 30 | 28.43 | 113% | 90% | 95% | 0% | Example |

(*1) The ratio (percentage) of the steel sheet tension $N_2$ in the initial stage of rolling to the steel sheet unit tension $N_1$ during steady-state rolling.
(*2) The ratio (percentage) of the steel sheet tension $N_2$ in the initial stage of rolling to the reference unit tension $N_0$.
(*3) The ratio (percentage) of the front end sheet thickness $t_1$ to the target sheet thickness $t_0$.

The invention claimed is:

1. A cold rolling method comprising:

rolling a steel sheet in multiple passes using a cold mill;

in a specific rolling pass in which the target sheet thickness to on an exit side of the rolling pass is less than or equal to a reference sheet thickness, determining whether or not the steel sheet unit tension $N_1$ during steady-state rolling exceeds the reference unit tension $N_0$ calculated by the following formula (1), and controlling the steel sheet unit tension $N_2$ in an initial stage of rolling a front end in an area extending at least 50 m from a leading end in the rolling direction of the steel sheet on an entry side of the specific rolling pass to be less than the reference unit tension No and less than the steel sheet unit tension $N_1$ during the steady-state rolling, in a case where the steel sheet unit tension $N_1$ during steady-state rolling exceeds the reference unit tension $N_0$ $$N_0=(150/9)t_0+27.1 \quad (1).$$

2. A cold rolling method comprising:

rolling a steel sheet in multiple passes using a cold mill;

in a specific rolling pass in which the target sheet thickness $t_0$ on an exit side of the rolling pass is less than or equal to a reference sheet thickness, determining whether or not the steel sheet unit tension $N_1$ during steady-state rolling exceeds the reference unit tension $N_0$ calculated by the following formula (1), and controlling the front end sheet thickness $t_1$, the front end being an area extending at least 50 m from a leading end in the rolling direction of the steel sheet, on the exit side of the specific rolling pass to be greater than the target sheet thickness $t_0$, in a case where the steel sheet unit tension $N_1$ during steady-state rolling exceeds the reference unit tension $N_0$ $$N_0=(150/9)t_0+27.1 \quad (1).$$

3. The cold rolling method according to claim 1, further comprising controlling the front end sheet thickness $t_1$ on the exit side of the specific rolling pass to be greater than the target sheet thickness $t_0$.

4. The cold rolling method according to claim 2, further comprising controlling the steel sheet unit tension $N_2$ in an initial stage of rolling on an entry side of the specific rolling pass to be less than the reference unit tension $N_0$ and less than the steel sheet unit tension $N_1$ during the steady-state rolling.

5. The cold rolling method according to claim 1, wherein the steel sheet contains 2.0 mass % to 4.0 mass % of Si, and the reference sheet thickness is 0.15 mm.

6. A method for producing a cold-rolled steel sheet by using the cold rolling method according to claim 1.

7. The cold rolling method according to claim 2, wherein the steel sheet contains 2.0 mass % to 4.0 mass % of Si, and the reference sheet thickness is 0.15 mm.

8. The cold rolling method according to claim 3, wherein the steel sheet contains 2.0 mass % to 4.0 mass % of Si, and the reference sheet thickness is 0.15 mm.

9. The cold rolling method according to claim 4, wherein the steel sheet contains 2.0 mass % to 4.0 mass % of Si, and the reference sheet thickness is 0.15 mm.

10. A method for producing a cold-rolled steel sheet by using the cold rolling method according to claim 2.

11. A method for producing a cold-rolled steel sheet by using the cold rolling method according to claim 3.

12. A method for producing a cold-rolled steel sheet by using the cold rolling method according to claim 4.

13. A method for producing a cold-rolled steel sheet by using the cold rolling method according to claim 5.

14. A method for producing a cold-rolled steel sheet by using the cold rolling method according to claim 7.

15. A method for producing a cold-rolled steel sheet by using the cold rolling method according to claim 8.

16. A method for producing a cold-rolled steel sheet by using the cold rolling method according to claim 9.

* * * * *